US006361160B2

(12) United States Patent
Feinn et al.

(10) Patent No.: US 6,361,160 B2
(45) Date of Patent: Mar. 26, 2002

(54) PRINT CARTRIDGE WITH ADHESIVE DISPENSED THROUGH WINDOW OF FLEXIBLE CIRCUIT

(75) Inventors: James A Feinn, San Diego, CA (US); Ronald J. Ender, Corvallis, OR (US)

(73) Assignee: Hewlett Packard Company, Palo Alto, CA (US)

( * ) Notice: Subject to any disclaimer, the term of this patent is extended or adjusted under 35 U.S.C. 154(b) by 0 days.

(21) Appl. No.: 09/823,388

(22) Filed: Mar. 29, 2001

Related U.S. Application Data

(63) Continuation of application No. 09/302,837, filed on Apr. 30, 1999.

(51) Int. Cl.[7] ..... B41J 2/175
(52) U.S. Cl. ..... 347/87
(58) Field of Search ..... 347/87, 20, 50, 347/47, 84–86

(56) References Cited

U.S. PATENT DOCUMENTS 5,538,586 A * 7/1996 Swanson et al. ..... 347/20
5,736,998 A * 4/1998 Caren et al. ..... 347/45

* cited by examiner

*Primary Examiner*—Judy Nguyen

(57) ABSTRACT

Disclosed is a print cartridge for an inkjet printer includes a flexible circuit having a nozzle member formed therein, the nozzle member including a plurality of ink orifices and the flexible circuit having window openings therein. The window openings expose electrical leads on the flexible circuit. A substrate containing a plurality of heating elements and associated ink ejection chambers, and having electrodes to which the electrical leads are bonded, is mounted on the back surface of the nozzle member. Each heating element is located proximate to an associated ink orifice. The back surface of the nozzle member extending over two or more outer edges of the substrate. A print cartridge body having a headland portion located proximate to the back surface of the nozzle member and including an inner raised wall circumscribing the substrate. The inner raised wall having an adhesive support surface formed thereon and having wall openings therein. The wall openings having an adhesive support surface. An adhesive layer is located between the back surface of the nozzle member and the inner raised wall and wall openings therein to affix the nozzle member to the headland and form an adhesive ink seal. The adhesive layer is located on the adhesive support surface of the inner raised wall and along the adhesive support surface within the wall openings therein and within the window openings so as to encapsulate the electrical leads bonded to the substrate electrodes.

10 Claims, 11 Drawing Sheets

PRINT CARTRIDGE WITH ADHESIVE DISPENSED THROUGH WINDOW OF FLEXIBLE CIRCUIT

CROSS-REFERENCE TO RELATED APPLICATIONS

This application is a continuation of U.S. patent application Ser. No. 09/302,837, filed on Apr. 30, 1999, entitled InkJet Print Cartridge Design To Decrease Ink Shorts Due to Ink Penetration of the Printhead.

U.S. patent application Ser. No. 09/303,246, filed concurrently herewith, entitled "Inkjet Print Cartridge Design for Decreasing Ink Shorts by Using an Elevated Substrate Support Surface to Increase Adhesive Sealing of the Printhead from Ink Penetration";

U.S. Pat. No. 5,852,460, entitled "Inkjet Print Cartridge Design to Decrease Deformation of the Printhead When Adhesively Sealing The Printhead to the Print Cartridge;"

U.S. Pat. No. 5,736,998, entitled "Inkjet Cartridge Design for Facilitating the Adhesive Sealing of a Printhead to an Ink Reservoir."

U.S. Pat. No. 5,450,113, entitled "Adhesive Seal for an Inkjet Printhead;"

U.S. Pat. No. 5,442,384, entitled "Integrated Nozzle Member and TAB Circuit for Inkjet Printhead;"

U.S. Pat. No. 5,278,584 to Keefe, et al., entitled "Ink Delivery System for an Inkjet Printhead;"

U.S. Pat. No. 5,291,226, entitled "Nozzle Member Including Ink Flow Channels."

The above patents are assigned to the present assignee and are incorporated herein by reference.

FIELD OF THE INVENTION

The present invention generally relates to inkjet printers and, more particularly, to the printhead portion of an inkjet print cartridge.

BACKGROUND OF THE INVENTION

Inkjet printers have gained wide acceptance. These printers are described by W. J. Lloyd and H. T. Taub in "Ink Jet Devices," Chapter 13 of *Output Hardcopy Devices* Ed. R. C. Durbeck and S. Sherr, San Diego: Academic Press. 1988) and U.S. Pat. Nos. 4,490,728 and 4,313,684. Inkjet printers produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink.

Inkjet printers print dots by ejecting very small drops of ink onto the print medium and typically include a movable carnage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed nozzles attached to a printhead substrate that incorporates an array of firing chambers which receive liquid ink from the ink reservoir. Each chamber has a thin-film resistor, known as a inkjet firing chamber resistor, located opposite the nozzle so ink can collect between it and the nozzle. The firing of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After each such completed movement or swath the medium is moved forward the width of the swath, and the ink cartridge begins the next swath. By proper selection and timing of the signals, the desired print is obtained on the medium.

In U.S. Pat. No. 5,442,384, entitled "Integrated Nozzle Member and TAB Circuit for Inkjet Printhead," a novel nozzle member for an inkjet print cartridge and method of forming the nozzle member are disclosed. A flexible circuit tape having conductive traces formed thereon has formed in it nozzles or orifices by Excimer laser ablation. The resulting flexible circuit having orifices and conductive traces may then have mounted on it a substrate containing heating elements associated with each of the orifices. The conductive traces formed on the back surface of the flexible circuit are then connected to the electrodes on the substrate and provide energization signals for the heating elements. A barrier layer, which may be a separate layer or formed in the nozzle member itself, includes vaporization chambers, surrounding each orifice, and ink flow channels which provide fluid communication between a ink reservoir and the vaporization chambers.

In U.S. Pat. No. 5,648,805, entitled "Adhesive Seal for an Inkjet Printhead," a procedure for sealing an integrated nozzle and flexible or tape circuit to a print cartridge is disclosed. A nozzle member containing an array of orifices has a substrate, having heater elements formed thereon, affixed to a back surface of the flexible circuit. Each orifice in the flexible circuit is associated with a single heating element formed on the substrate. The back surface of the flexible circuit extends beyond the outer edges of the substrate. Ink is supplied from an ink reservoir to the orifices by a fluid channel within a barrier layer between the flexible circuit and the substrate. In either embodiment the flexible circuit is adhesively sealed with respect to the print cartridge body by forming an ink seal, circumscribing the substrate, between the back surface of the flexible circuit and the body. This method and structure of providing a seal directly between a flexible circuit and an ink reservoir body has many advantages.

However, during manufacturing, the headland design of previous print cartridges had several disadvantages, including difficulty in controlling the edge seal to the die or substrate without having adhesive getting into the nozzle and clogging them, or on the other hand, voids of adhesive in the flexible circuit bond window. It was also very difficult to control the adhesive bulge through the window caused by excess adhesive, or varying die placement. All of these problems result in extremely high yield losses when manufacturing thermal inkjet print cartridges.

U.S. Pat. No. 5,736,998, entitled "Inkjet Cartridge Design for Facilitating the Adhesive Sealing of a Printhead to an Ink Reservoir," and U.S. Pat. No. 5,852,460, entitled "Inkjet Print Cartridge Design to Decrease Deformation of the Printhead When Adhesively Sealing The Printhead to the Print Cartridge;" improved headland designs are disclosed which alleviate some of the above-mentioned problems.

However, these designs did not address the problem of ink shorts caused by ink leaking into the conductive leads and conductive traces of the flexible circuit. Flexible circuit leads are bonded to pads or electrodes on the outer edges of the substrate. To enable this bonding, a window is created in the flexible circuit to allow a bonder thermode to apply force and temperature to the flexible circuit leads that are resting on the bond pads. After the leads have been bonded, an encapsulant is dispensed across the window to protect the exposed bond pad region from intrusion of ink or contamination.

On most flexible circuits these leads are also protected on the back side by a laminated cover layer. In addition, the leads are further protected by the structural adhesive that is used to adhere the flexible circuit to the print cartridge body. However, there are a number of disadvantages to this approach. First, there is a region at both ends of the substrate where the flexible circuit traces cannot be protected by the cover layer. In this region, the traces are only protected by the structural adhesive, and are therefore susceptible to corrosion and electrical shorting if ink penetrates the structural adhesive to flexible tape interface. This penetration of ink is increased due to the fact that the flexible tape to structural interface provides a wicking surface for the ink. This can lead to corrosion and electrical shorting behind the substrate. Second, the encapsulant and the structural adhesive are cured at different stages in the manufacturing process and this creates a weak "cold joint" between the adhesive and encapsulant that can fail and permit ink intrusion. Third, air pockets may be created on the underside of the flexible tape near the ends of the substrate when the structural adhesive does not squish uniformly against the flexible circuit during attachment of the flexible circuit to the print cartridge body. These air pockets can provide a path for ink to the flexible circuit traces or the bond pad region and thus lead to corrosion and electrical shorting of the leads or traces.

Accordingly, there is a need for an improved method of encapsulating the flexible circuit leads that reduces ink shorts and corrosion due to ink penetration into the flexible circuit leads.

SUMMARY OF THE INVENTION

In a preferred embodiment of the present invention, a print cartridge for an inkjet printer includes a flexible circuit having a nozzle member formed therein, the nozzle member including a plurality of ink orifices and the flexible circuit having window openings therein. The window openings expose electrical leads on the flexible circuit. A substrate containing a plurality of heating elements and associated ink ejection chambers, and having electrodes to which the electrical leads are bonded, is mounted on the back surface of the nozzle member. Each heating element is located proximate to an associated ink orifice. The back surface of the nozzle member extending over two or more outer edges of the substrate. A print cartridge body having a headland portion located proximate to the back surface of the nozzle member and including an inner raised wall circumscribing the substrate. The inner raised wall having an adhesive support surface formed thereon and having wall openings therein. The wall openings having an adhesive support surface. An adhesive layer is located between the back surface of the nozzle member and the headland to affix the nozzle member to the headland and form an adhesive ink seal. The adhesive layer is located on the adhesive support surface of the inner raised wall and along the adhesive support surface within the wall openings therein and within the window openings so as to encapsulate the electrical leads bonded to the substrate electrodes.

In another embodiment, a method of affixing a flexible circuit to an inkjet print cartridge body comprises providing a flexible circuit having a nozzle member formed therein, the nozzle member including a plurality of ink orifices. The flexible circuit having electrical leads and having a substrate mounted on a back surface of the nozzle member. The substrate having a plurality of heating elements and associated ink ejection chambers and having electrodes to which the electrical leads are bonded. Each heating element being located proximate to an associated ink orifice and the back surface of the nozzle member extending over two or more outer edges of the substrate. Providing a print cartridge body having a headland portion located proximate to the back surface of the nozzle member and including an inner raised wall circumscribing the substrate, the inner raised wall having an adhesive support surface formed thereon and having wall openings therein, the wall openings having an adhesive support surface. Dispensing an adhesive layer between the back surface of the nozzle member and the headland to affix the nozzle member to the headland and form an adhesive ink seal. The adhesive layer located on the adhesive support surface of the inner raised wall and along the support surface within the wall openings therein. Positioning the back surface of the nozzle member with respect to the headland such that the adhesive circumscribes the substrate and affixes the back surface of the nozzle member to the headland. Dispensing the adhesive through the window openings so as to encapsulate the electrical leads bonded to the substrate electrodes.

DETAILED DESCRIPTION OF THE PREFERRED EMBODIMENTS

Figure 1:
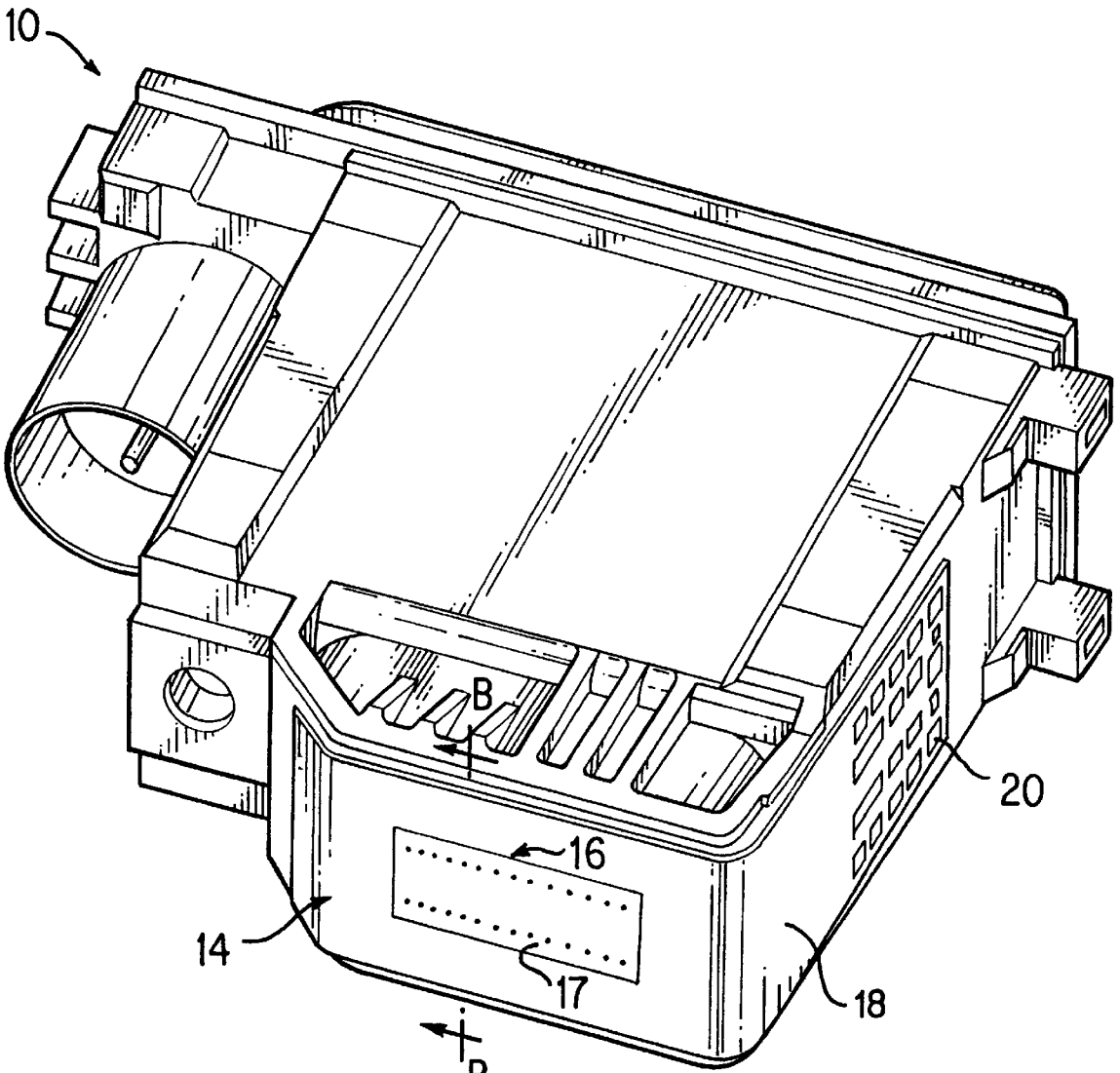
FIG. 1 is a perspective view of an inkjet print cartridge according to one embodiment of the present invention.

Referring to FIG. 1, reference numeral 10 generally indicates an inkjet print cartridge incorporating a printhead according to one embodiment of the present invention. The inkjet print cartridge 10 includes an internal ink reservoir (not shown) and a printhead 14, where the printhead 14 is formed using Tape Automated Bonding (TAB). The printhead 14 (hereinafter "TAB head assembly 14") includes a nozzle member 16 comprising two parallel columns of offset holes or orifices 17 formed in a flexible polymer flexible circuit 18 by, for example, laser ablation. The flexible circuit 18 provides for the routing of conductive traces 36 which are connected at one end to electrodes on a substrate (described below) and on the other end to contact pads 20. The print cartridge 10 is designed to be installed in a printer so that the contact pads 20 on the front surface of the flexible circuit 18, contact printer electrodes providing externally generated energization signals to the printhead.

Figures 2A, 2B:
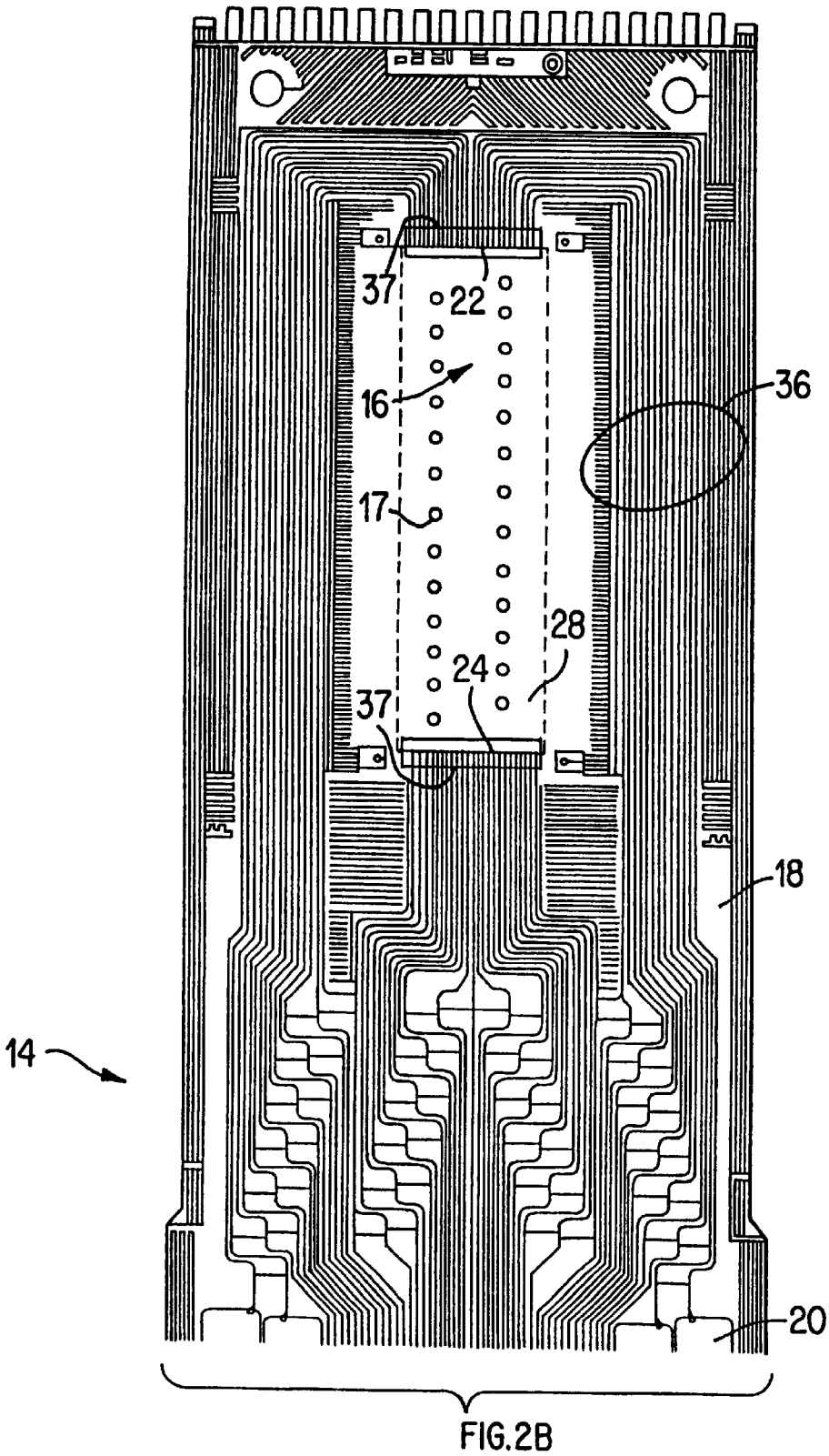
FIG. 2 is a plan view of the front surface of a Tape Automated Bonding (TAB) printhead assembly (hereinafter "TAB head assembly") removed from a print cartridge.
Figures 2A, 2B:
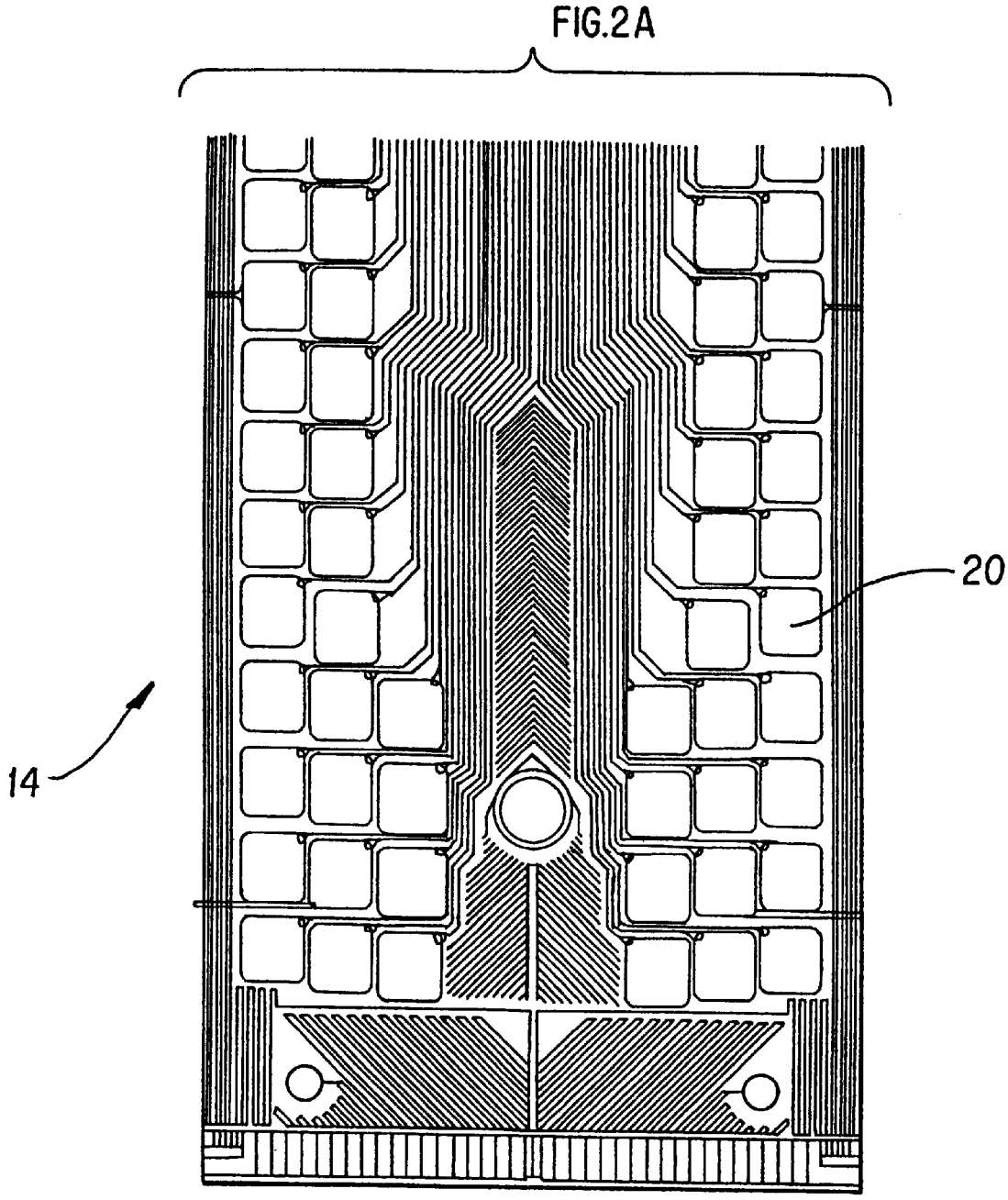

FIGS. 2A and 2B show front views of a TAB head assembly 14 removed from a print cartridge 10. TAB head assembly 14 has affixed to the back of the flexible circuit 18 a silicon substrate 28 (not shown) containing a plurality of individually energizable thin film resistors. Each resistor is located generally behind a single orifice 17 and acts as an ohmic heater when selectively energized by one or more pulses applied sequentially or simultaneously to one or more of the contact pads 20. Windows 22 and 24 extend through the flexible circuit 18 and are used to facilitate bonding of the other ends of the conductive traces 36 to electrodes on the silicon substrate.

The orifices 17 and conductive traces 36 may be of any size, number, and pattern, and the various figures are designed to simply and clearly show the features of the invention. The relative dimensions of the various features have been greatly adjusted for the sake of clarity.

Figure 3:
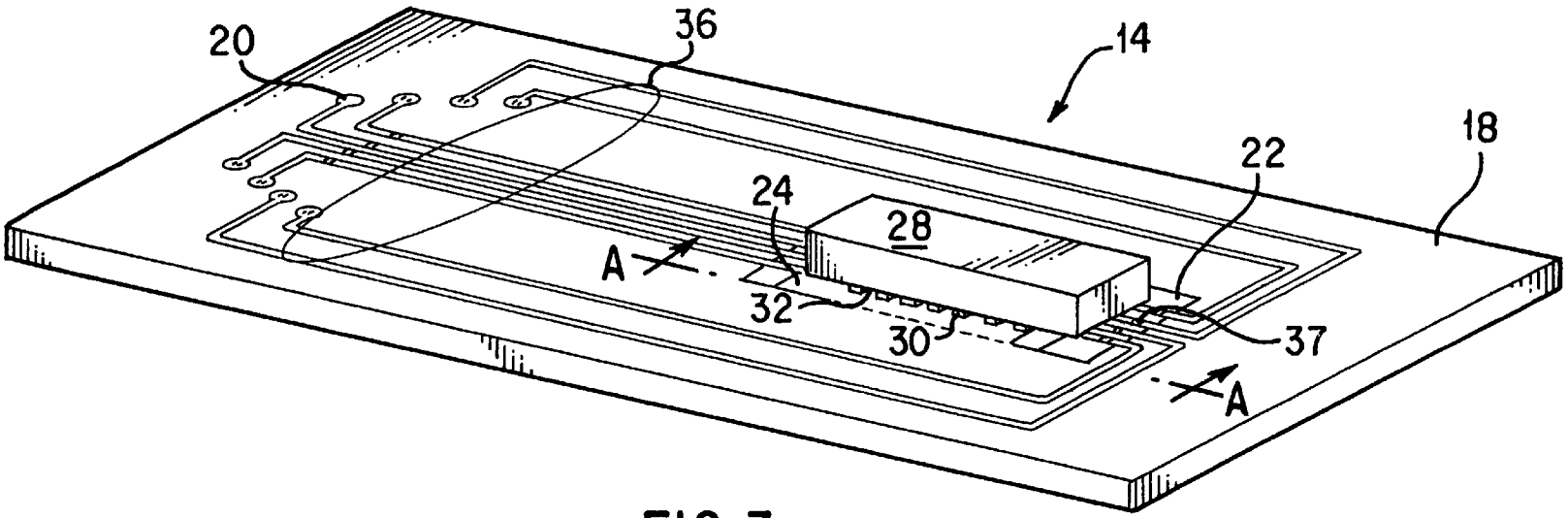
FIG. 3 is a highly simplified perspective view of the back surface of the TAB head assembly of FIG. 2 with a silicon substrate mounted thereon and the conductive leads attached to the substrate.

FIG. 3 shows a highly simplified view of the back surface of a Tape Automated Bonding (TAB) printhead assembly 14 (hereinafter "TAB head assembly"). The back surface of the flexible circuit 18 includes conductive traces 36 formed thereon using a conventional photolithographic etching and/or plating process. The silicon die or substrate 28 is mounted to the back of the flexible circuit 18 with the nozzles or orifices 17 aligned with an ink vaporization chamber 32. The conductive traces 36 are terminated by leads 37 that are bonded to electrodes 40 on the substrate 28 and by contact pads 20 designed to interconnect with a printer. Also shown is one edge of the barrier layer 30 containing vaporization chambers 32 formed on the substrate 28. Shown along the edge of the barrier layer 30 are the entrances to the vaporization chambers 32 which receive ink from an internal ink reservoir within the print cartridge 10. The windows 22 and 24 allow access to the leads of the conductive traces 36 and the substrate electrodes 40 (shown in FIG. 4) to facilitate bonding of the leads to the electrodes.

Figure 4:
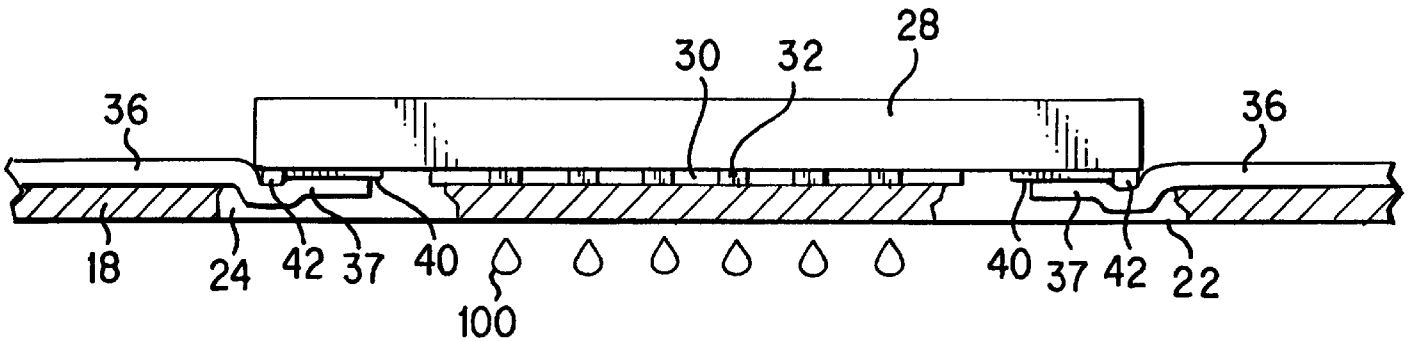
FIG. 4 is a side elevational view in cross-section taken along line A—A in FIG. 3 illustrating the attachment of conductive leads to electrodes on the silicon substrate.

FIG. 4 shows a side view cross-section taken along line A—A in FIG. 3 illustrating the connection of the ends of the conductive traces 36 to the electrodes 40 formed on the substrate 28. A portion 42 of the barrier layer 30 is used to insulate the leads 37 of the conductive traces 36 from the substrate 28. Also shown is a side view of the flexible circuit 18, the barrier layer 30, the windows 22 and 24, and the entrances of the ink vaporization chambers 32. Droplets of ink 100 are shown being ejected from orifice holes associated with each of the ink vaporization chambers 32.

Figure 5:
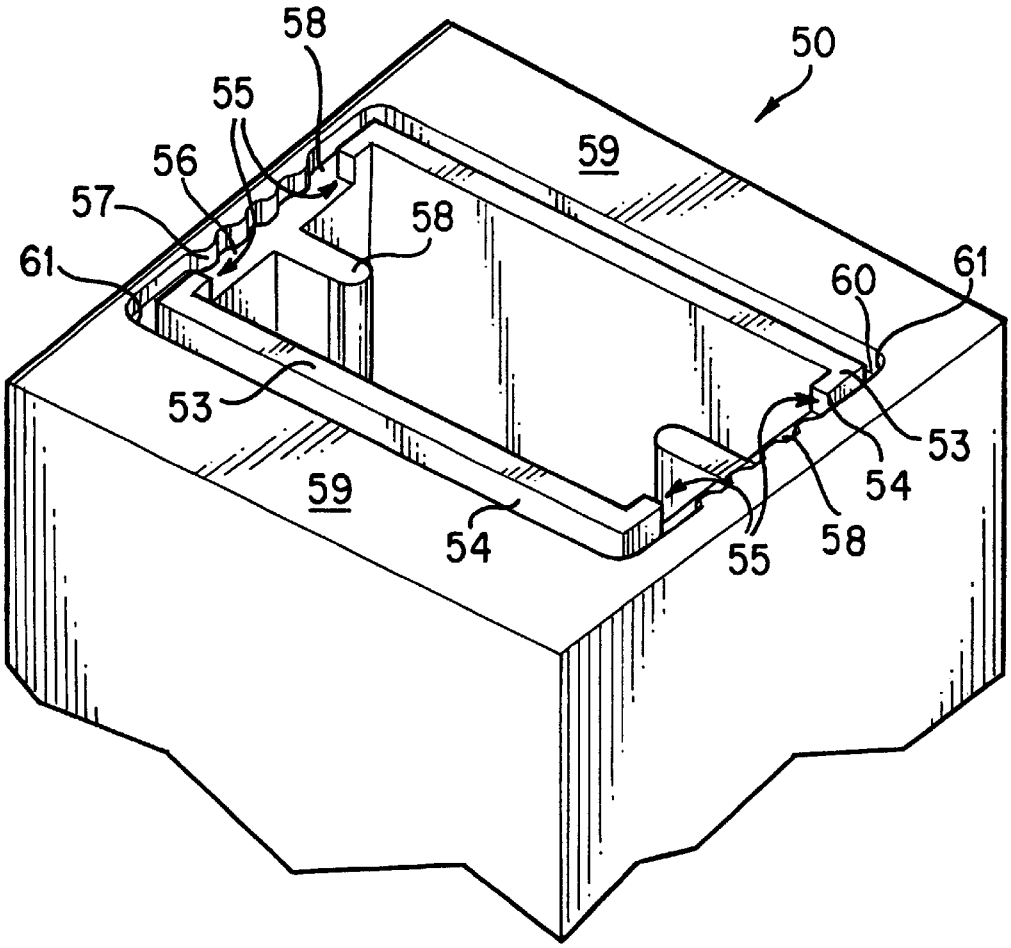
FIG. 5 is a perspective view of the headland area of the inkjet print cartridge of FIG. 1.
Figure 6:
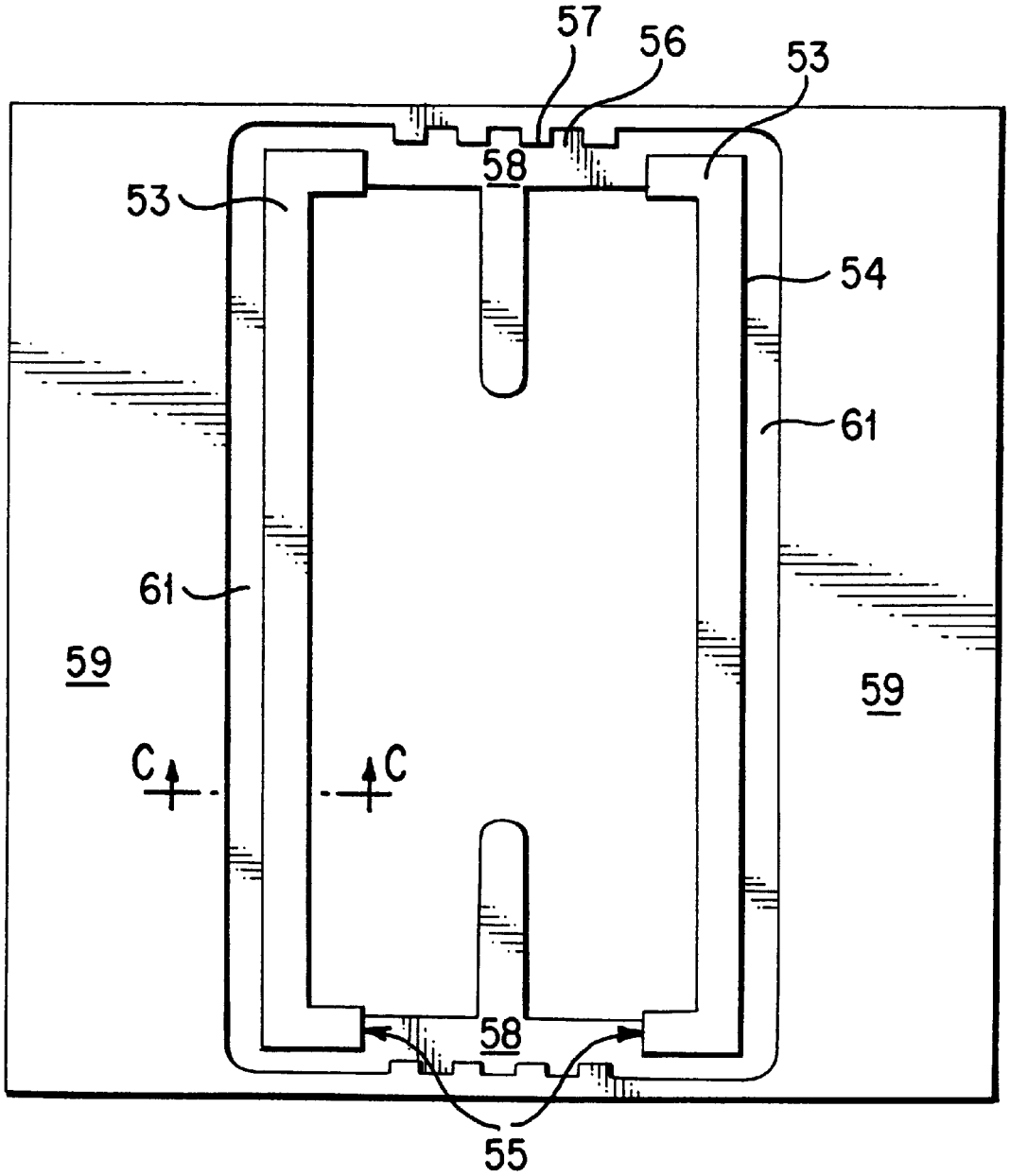
FIG. 6 is a top plan view of the headland area of the inkjet print cartridge of FIG. 1.
Figure 7:
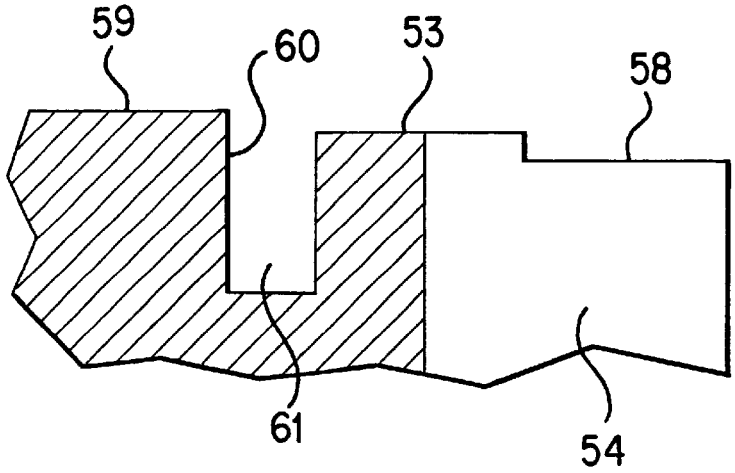
FIG. 7 is a side elevational view in cross-section taken along line C—C in FIG. 6 illustrating the configuration of the adhesive support surface, inner wall, gutter and of the headland design.

FIG. 5 shows the headland area 50 of print cartridge 10 of FIG. 1 in a perspective view and with the TAB head assembly 14 removed to reveal the headland design used in providing a seal between the TAB head assembly 14 and the body of the print cartridge 10. FIG. 6 shows the headland area 50 of FIG. 5 in a top plan view. FIG. 7 shows the headland area 50 in a cross-sectional view along sectional line C—C in FIG. 6.

Shown in FIGS. 5, 6 and 7 are an inner raised wall 54, an adhesive support surface 53 on the inner raised wall, openings 55 in the inner raised wall 54, a substrate support surface 58, a flat top surface 59 and a gutter 61. Also shown are adhesive ridges 57 and the area 56 on the substrate support surface 58 between the adhesive ridges 57.

Figure 8:
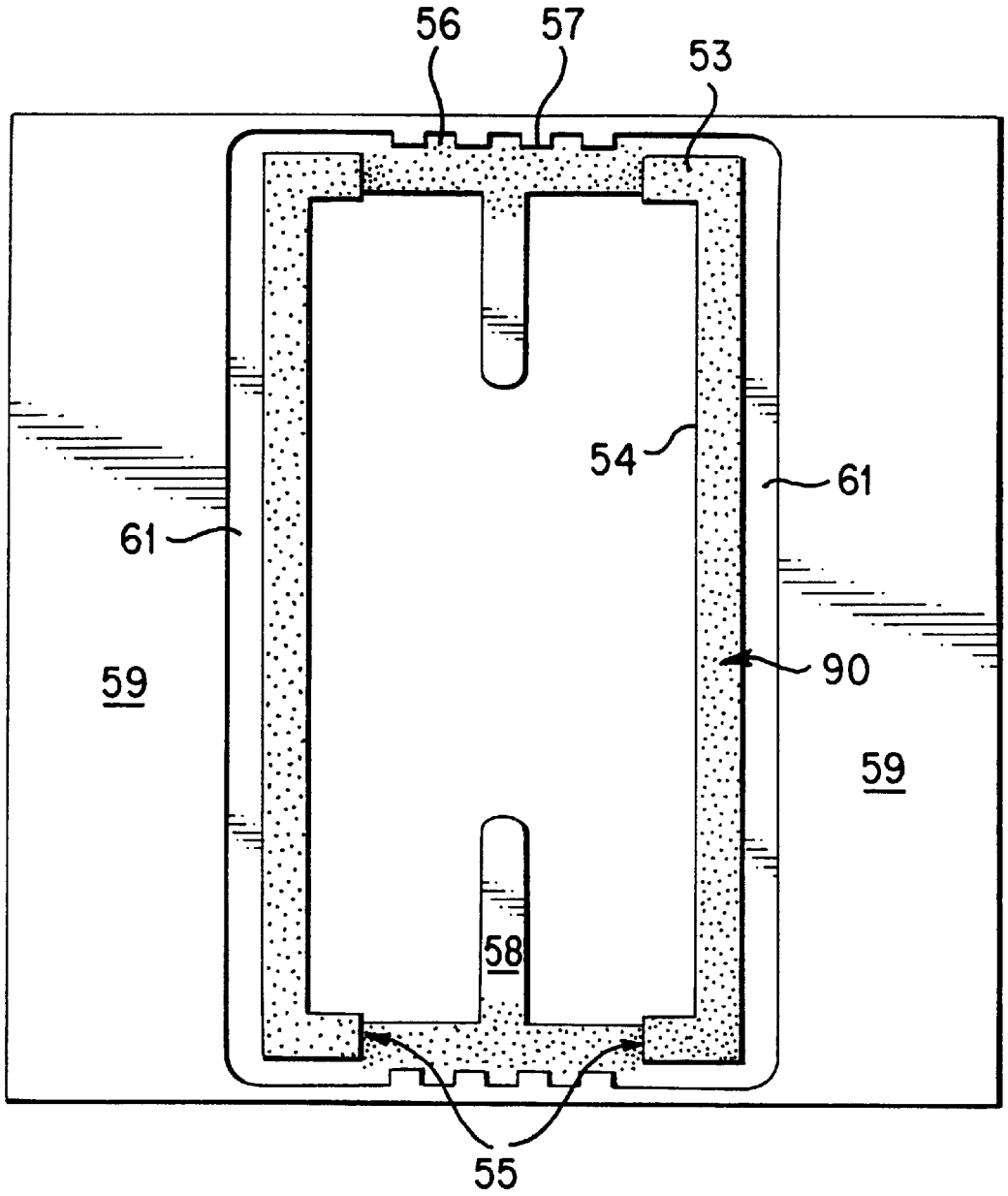
FIG. 8 top plan view of the headland area showing generally the location of the adhesive bead prior to placing the TAB head assembly on the headland area.

FIG. 8 is top plan view showing generally the location of the dispensed adhesive 90 along the adhesive support surface 53 of inner raised wall 54 and across substrate support surface 58 in the wall openings 55 of the inner raised wall 54 and adjacent to and suspended off of adhesive ridges 57.

The adhesive circumscribes the substrate 28 when the TAB head assembly 14 is properly positioned and pressed down on the headland 50. The adhesive 90 forms a structural attachment between the TAB head assembly 14 and the inner raised wall 54 and the support surface 58 of the print cartridge 10. The adhesive also provides a liquid seal between the above-described circumscribed location and the back of the TAB head assembly 14 when TAB head assembly 14 is affixed to headland 50.

Figure 9:
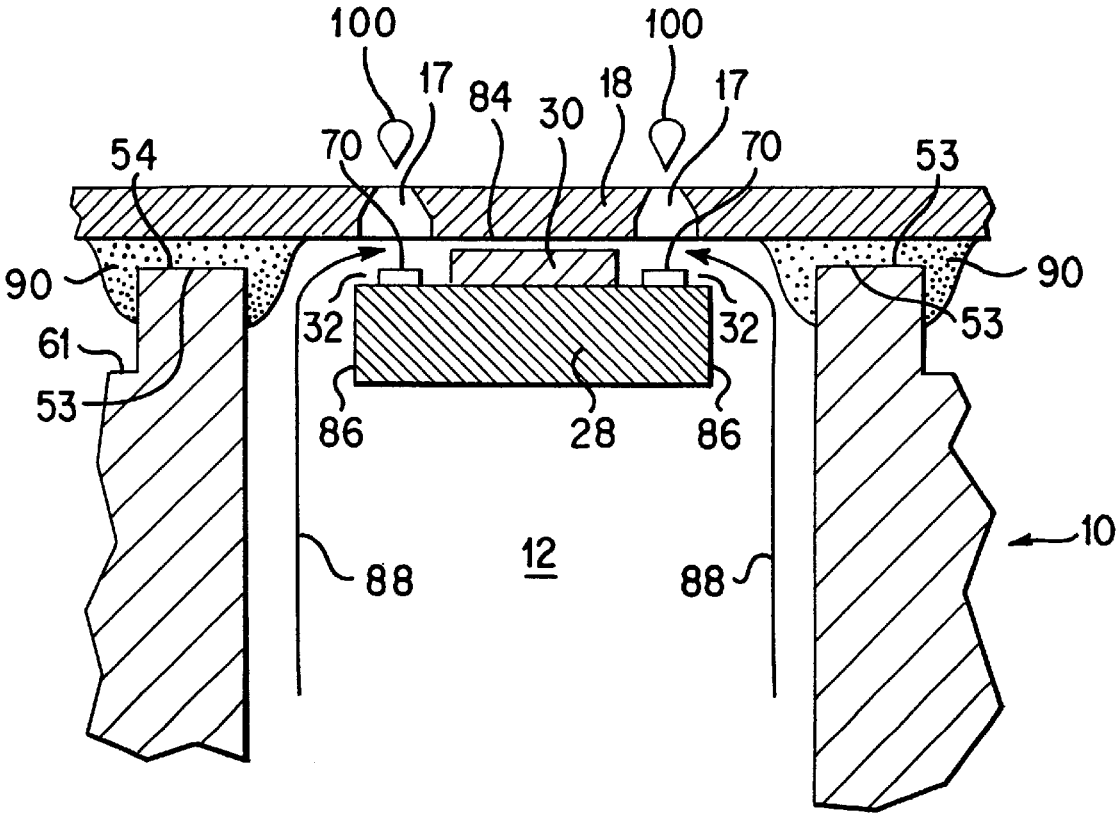
FIG. 9 is a schematic cross-sectional view taken along line B—B of FIG. 1 showing the adhesive seal between the TAB head assembly and the print cartridge.

FIG. 9 is a cross-sectional view taken along line B—B of FIG. 1 showing vaporization chambers 32, thin film resistors 70, and orifices 17 after the barrier layer 30 and substrate 28 are secured to the back of the flexible circuit 18 at location 84 and the flexible circuit is secured to the body of the print cartridge 10 by adhesive 90. A side edge of the substrate 28 is shown as 86. In operation, ink flows from reservoir 12 around the side edge 86 of the substrate 28, and into vaporization chamber 32, as shown by the arrow 88. Upon energization of the thin film resistor 70, a thin layer of the adjacent ink is superheated, causing a droplet of ink 100 to be ejected through the orifice 17. The vaporization chamber 32 is then refilled with ink by capillary action. Also shown is a portion of the adhesive seal 90, applied to the inner raised wall 54 surrounding the substrate 28.

Prior headland designs have not adequately addressed the problem of "ink shorts" occurring near the leads 37 of the flexible circuit 18 of TAB head assembly 14 due to ink penetrating the flex circuit 18 in the region of the leads 37. These ink shorts cause malfunctioning of the printhead and premature failure of the print cartridge.

Figure 10:
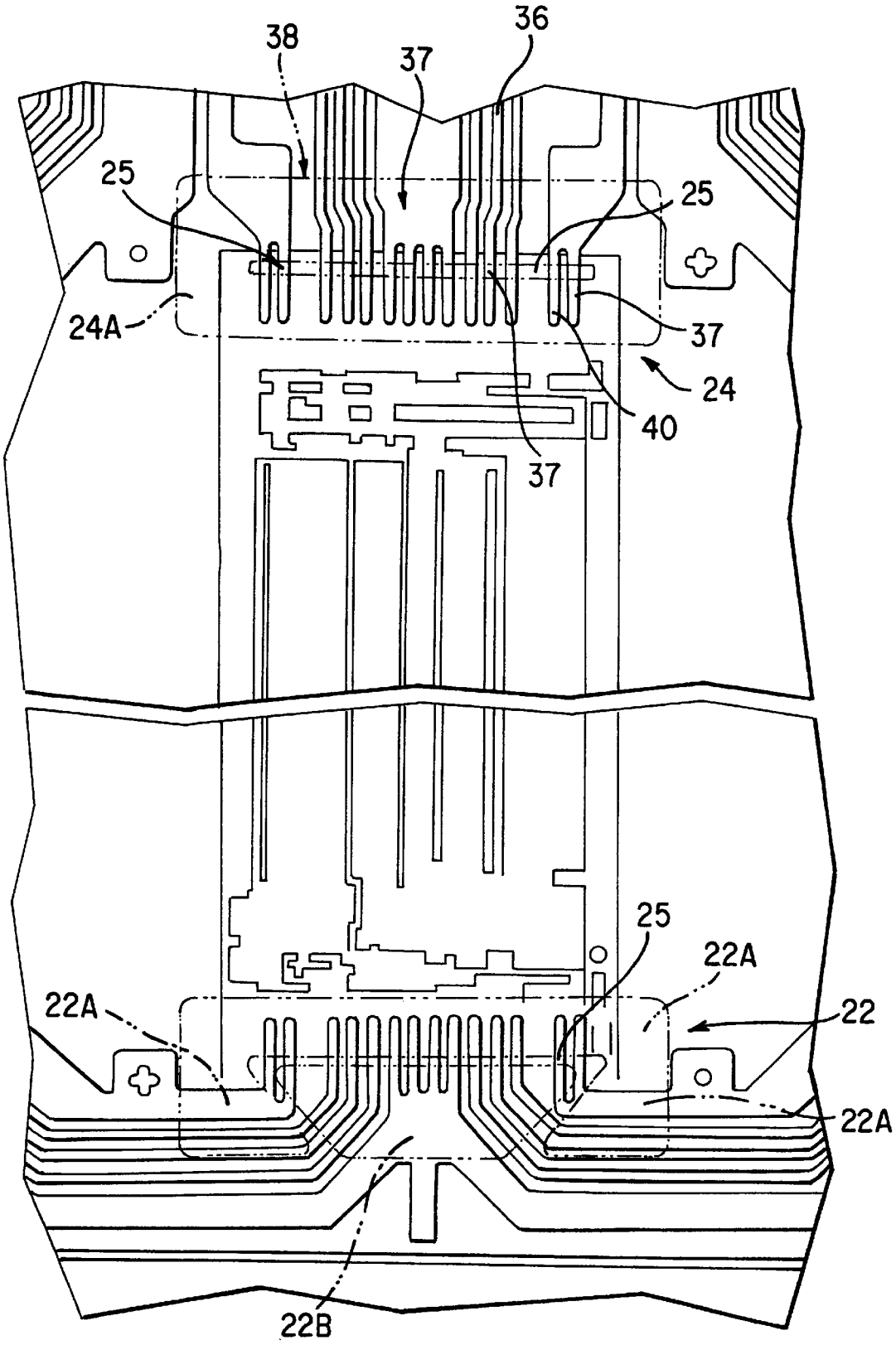
FIG. 10 shows a TAB head assembly employing one embodiment of the present invention
Figure 11:
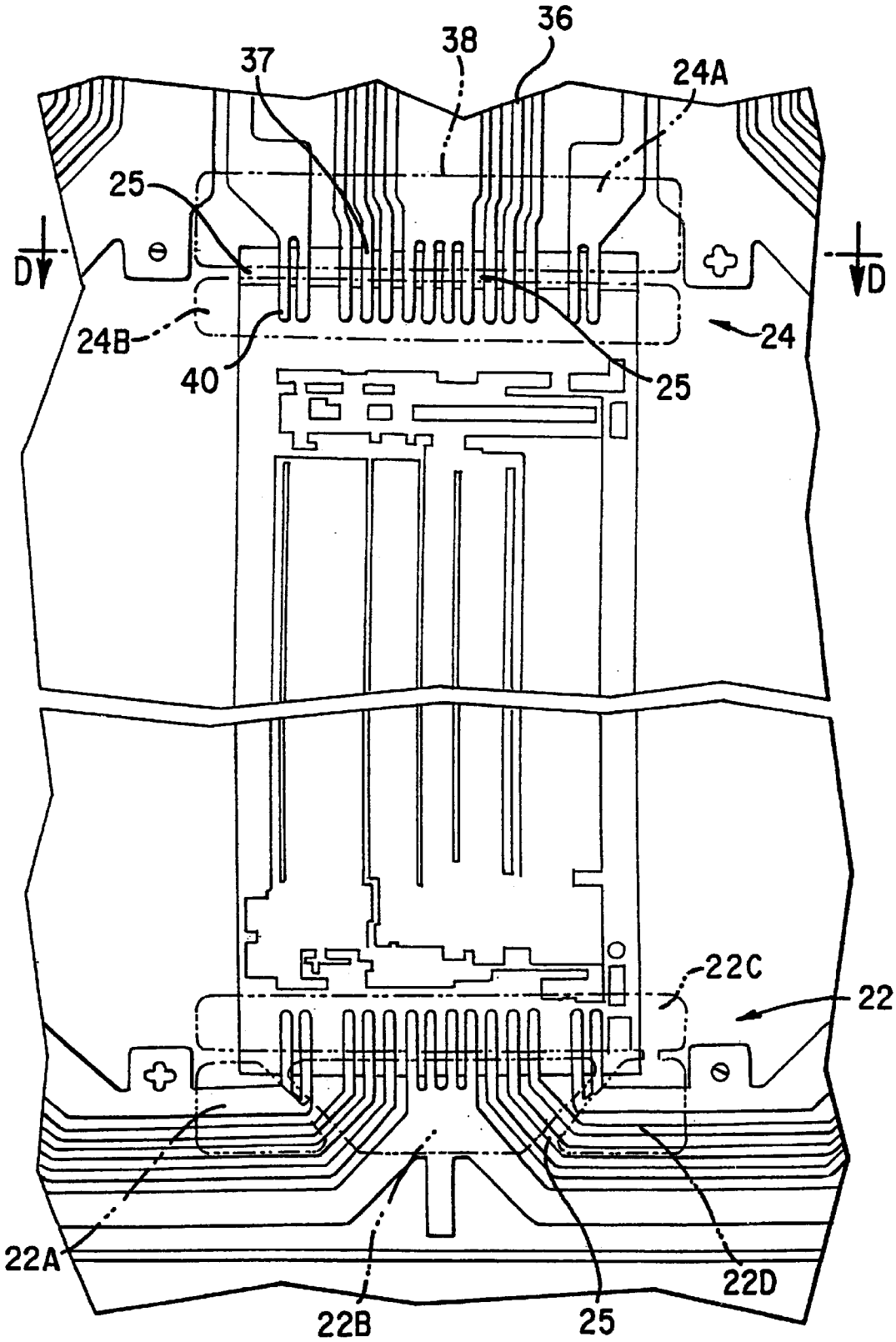
FIG. 11 shows a TAB head assembly employing another embodiment of the present invention

The windows 22, 24 in the flexible circuit 18 are chemically milled in the flexible tape 18. FIGS. 10 and 11 show TAB head assemblies employing different embodiments of the present invention. In the embodiment of FIG. 10, window 22 consists of two separate windows 22A and 22B. Also shown is a small support strip 25 of flexible tape 18 which is retained between the windows 22A, 22B. The support strip 25 may be approximately 100 to 200 micrometers wide. Window 24 consists of a single window 24A with a small support strip 25 of flexible tape 18 which is retained within the window 24A. The reason for the differences in windows 22 and 24 is due to the different routing of the conductive traces 36 and leads 37.

In the embodiment of FIG. 11, window 22 consists of four separate windows 22A, 22B, 22C and 22D. Also shown is a small support strip 25 of flexible tape 18 which is retained between each of the windows. Window 24 consists of a two windows 24A and 24B with a small support strip 25 of flexible tape 18 which is retained between the windows 24A and 24B.

The purpose of support strip 25 is to help support the leads 37 so that they are less likely to get bent or twisted. Support strip 25 becomes fully encapsulated after the adhesive is dispensed as described below. Support strip 25 may be eliminated, but then greater care is required in handling the leads 37 of the flexible circuit.

The portion of the windows 22, 24 which are off the substrate should extend back approximately to the location on the flexible circuit 18 where the laminated cover layer 38 of the flex circuit 18 terminates. Thus, the openings in windows 22, 24 must be large enough to be open near the end of the cover layer 38 so that the leads 37 not having any cover layer are fully encapsulated by the adhesive. In accordance with this invention, the encapsulant dispense into windows 22, 24 is omitted during intermediate assembly of the flexible circuit 18.

As the TAB head assembly 14 is pressed down onto the headland 50, the adhesive is squished down. The adhesive squishes through the wall openings 55 in the inner raised wall to encapsulate the traces leading to electrodes on the substrate. The adhesive also squishes up through the windows 22, 24 and flush with the top surface of the windows.

From the adhesive surface 53 of the inner raised walls 54, the adhesive overspills inwardly and outwardly into the gutter 61 between the inner raised walls 54 and the outer raised wall 60 which blocks farther outward displacement of the adhesive. From the wall openings 55 in the inner raised wall, the adhesive squishes both inwardly and upwardly through windows 22, 24.

When the flexible circuit 18 is placed onto the headland area 50 of the body of the print cartridge 10 and adhesive 90 squish from the below the TAB Head Assembly 14 ("bottom") partially encapsulates the exposed leads 37 while adhesive 90 is applied from the top of the TAB Head Assembly 14 through the windows 22, 24 ("top") to completely encapsulate the leads 37. When the adhesive 90 is cured, the "top" and "bottom" adhesives flow together to form a void-free, 360 degree seamless protective encapsulation of the leads 37.

This seal formed by the adhesive 90 circumscribing the substrate 28 allows ink to flow around the sides of the substrate 28 to the vaporization chambers 32 formed in the barrier layer 30, but will prevent ink from seeping out from under the TAB head assembly 14. Thus, this adhesive seal 90 provides a strong mechanical coupling of the TAB head assembly 14 to the print cartridge 10, a fluidic seal and flexible circuit lead encapsulation. The displacement of the adhesive not only serves as an ink seal, but encapsulates the conductive traces in the vicinity of the windows 22, 24 from underneath to protect the conductive traces from ink.

Optionally, to control the bulge of adhesive through the windows 22, 24 in the TAB head assembly 14 caused by excess adhesive, or varying substrate placement, adhesive ridges 57 and available area 56 between the adhesive ridges 57 may be provided. In this situation, the structural adhesive when dispensed is bounded by the protruding edges of the adhesive ridges 57. When the TAB head assembly 14 is placed on the headland 50, the adhesive squishes up and partially fills out the back of the windows 22, 24 of the TAB head assembly 14 and then begins to fill up the available area 56 between the adhesive ridges 57. Essentially, no adhesive will squish through the windows 22, 24 until the available area 56 between the adhesive ridges 57 are all filled with adhesive. Therefore, when a larger volume of adhesive is applied, the open areas 56 between the adhesive ridges 57 begins to fill in without a great increase in adhesive bulge through the windows 22, 24.

Figure 12:
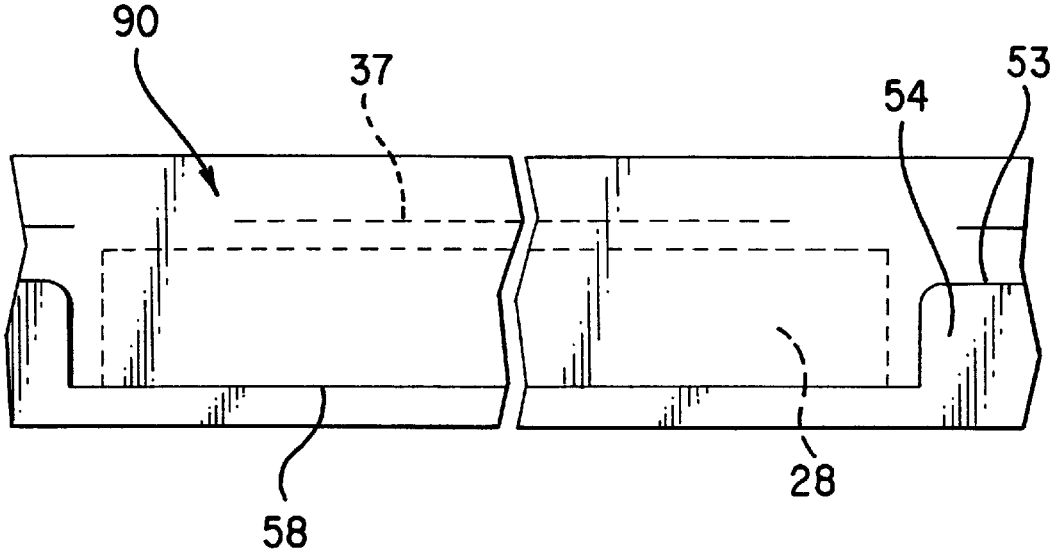
FIG. 12 is a schematic cross-sectional view taken along line D—D of FIG. 11 showing the adhesive seal between the TAB head assembly and the print cartridge and the encapsulation of the flexible circuit leads.

FIG. 12 is a schematic cross-sectional view taken along line D—-D of FIG. 11 showing the adhesive seal between the TAB head assembly 14 and the print cartridge and the encapsulation of the flexible circuit leads 37.

The present invention provides a 360 degree seamless encapsulation of the flexible circuit leads and traces that extend from the cover layer edge to the substrate edge. The design and process of the present invention for flexible circuit lead encapsulation through dual windows, or alternatively an enlarged single window, in the flexible tape by removing the flexible tape over the flexible circuit leads provides 360 degree encapsulation of the flexible leads. By providing this 360 degree encapsulation of the flexible circuit leads, corrosion and electrical shorting are greatly reduced in this region. Also, the process and design for flexible circuit lead encapsulation of the present invention produces far fewer air pockets because access to all sides of the flexible circuit leads is provided. The elimination of air pockets in the adhesive adds robustness against ink shorts. A single encapsulation process is employed thereby eliminating the encapsulation process in the intermediate assembly of the printhead. Moreover, a single adhesive is employed for both encapsulation and adhesion of the printhead assembly to the print cartridge body.

The foregoing has described the principles, preferred embodiments and modes of operation of the present invention. However, the invention should not be construed as being limited to the particular embodiments discussed. As an example, the above-described inventions can be used in conjunction with inkjet printers that are not of the thermal type, as well as inkjet printers that are of the thermal type. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method of affixing a flexible circuit to an inkjet print cartridge body comprising:

providing a flexible circuit having a nozzle member formed therein, said nozzle member including a plurality of ink orifices, said flexible circuit having elec trical leads exposed by at least one window formed in said flexible circuit, said at least one window having a top opening flushed with a top surface of said nozzle member, said flexible circuit having a substrate mounted on a back surface of said nozzle member, said substrate having a plurality of ink injection elements, said substrate having electrodes to which the electrical leads are bonded, each ink ejection element being located proximate to an associated ink orifice;

providing a print cartridge body having a support portion for affixing the back surface of said nozzle member thereto;

dispensing an adhesive layer of a first adhesive material between the back surface of said nozzle member and said support portion;

affixing said nozzle member to said support portion to form an adhesive ink seal;

dispensing said first adhesive material through said top opening of said at least one window prior to said adhesive layer being cured so as to partially combine said first adhesive material in said adhesive layer with said first adhesive material dispensed through said at least one window; and concurrently curing said adhesive layer and said first adhesive material dispensed through said at least one window.

2. The method of claim 1 wherein said dispensing said first adhesive material comprises dispensing said first adhesive material through said at least one window so as to encapsulate electrical leads bonded to said electrodes.

3. The method of claim 1 wherein said dispensing said adhesive layer comprises dispensing said adhesive layer to circumscribe said substrate while allowing ink to flow around sides of said substrate to said ink ejection elements.

4. The method of claim 1 wherein said at least one window comprises two windows, said windows being located at opposite ends of said substrate.

5. The method of claim 1 wherein said providing said flexible circuit comprises providing said flexible circuit with said at least one window having a support strip within said at least one window, said dispensing said first adhesive through said at least one window encapsulating said support strip with said first adhesive material.

6. A printing device comprising:

a flexible circuit having a nozzle member formed therein, said nozzle member including a plurality of ink orifices, said flexible circuit having electrical leads exposed by at least one window formed in said flexible circuit, said at least one window having a top opening flushed with a top surface of said nozzle member, said flexible circuit having a substrate mounted on a back surface of said nozzle member, said substrate having a plurality of ink injection elements, said substrate having electrodes to which the electrical leads are bonded, each ink ejection element being located proximate to an associated ink orifice;

a print cartridge body having a support portion affixed to the back surface of said nozzle member; and an adhesive layer of a first adhesive material between the back surface of said nozzle member and said support portion affixing said nozzle member to said support portion to form an adhesive ink seal, said first adhesive material dispensed through said top opening of said at least one window prior to said adhesive layer being cured so as to partially combine said first adhesive material in said adhesive layer with said first adhesive material dispensed through said at least one window, wherein said adhesive layer and said first adhesive material dispensed through said at least one window are concurrently cured.

7. The device of claim 6 wherein said first adhesive material dispensed through said at least one window encapsulates electrical leads bonded to said substrate electrodes.

8. The device of claim 6 wherein said adhesive layer circumscribes said substrate while allowing ink to flow around sides of the substrate to said ink ejection elements.

9. The device of claim 6 wherein said at least one window comprises two windows, said windows being located at opposite ends of said substrate.

10. The device of claim 6 wherein said flexible circuit has a support strip within said at least one window, said first adhesive dispensed through said at least one window encapsulating said support strip with said first adhesive material.

* * * * *